US005378419A

United States Patent [19]

Capoccia

[11] Patent Number: 5,378,419

[45] Date of Patent: Jan. 3, 1995

[54] METHOD FOR TRANSFERRING PATTERNS TO A STIPPLABLE TOPPING COMPOUND USING A STIPPLE BRUSH

[76] Inventor: John S. Capoccia, 6124 Cheshire Rd., Galena, Ohio 43021

[21] Appl. No.: 233,355

[22] Filed: Apr. 26, 1994

Related U.S. Application Data

[60] Division of Ser. No. 73,776, Jun. 5, 1993, which is a continuation-in-part of Ser. No. 773,020, Oct. 7, 1991, abandoned, which is a continuation-in-part of Ser. No. 597,885, Oct. 15, 1990, abandoned.

[51] Int. Cl.[6] ..... B28B 17/00; B05D 3/12; A46B 9/02

[52] U.S. Cl. ..... 264/162; 15/16; 15/191.1; 15/DIG. 5; 264/33; 427/274

[58] Field of Search ..... 15/28, 143.1, 159.1, 15/160, 180, 191.1, 192, 193, 210.5, DIG. 5; 7/105; D4/104–123, 127–138, 199; D8/45; 427/274, 277; 264/33, 132–133, 162; 425/87

[56] References Cited

U.S. PATENT DOCUMENTS

| | | | |
|---|---|---|---|
| D. 99,485 | 4/1936 | Weber | 15/160 X |
| 269,144 | 12/1882 | West | 427/274 |
| 396,812 | 1/1889 | Faber | 15/180 |
| 437,095 | 9/1890 | Church | 427/277 |
| 1,372,308 | 3/1921 | MacRae | 15/180 X |
| 1,449,856 | 3/1923 | Hampson | 427/274 |
| 1,497,921 | 6/1924 | Levedahl | 15/180 X |
| 1,936,174 | 11/1933 | Renschin | 15/160 X |
| 1,967,651 | 7/1934 | Anderson | 15/180 |
| 3,181,193 | 5/1965 | Nobles et al. | 15/180 X |
| 3,943,594 | 3/1976 | Alvin | 15/180 |
| 4,399,581 | 8/1983 | Tuzzolino | 15/176.3 |
| 4,606,091 | 8/1986 | Sartori | 15/160 X |

FOREIGN PATENT DOCUMENTS

| | | | |
|---|---|---|---|
| 1059066 | 11/1953 | France | 15/160 |
| 528920 | 7/1931 | Germany | 15/28 |
| 1433979 | 4/1976 | United Kingdom | 15/180 |

*Primary Examiner*—David A. Scherbel
*Assistant Examiner*—Charles Cooley
*Attorney, Agent, or Firm*—Mueller and Smith

[57] ABSTRACT

A method for transferring generally radial patterns to topping compound applied to a surface using a stipple brush. The stipple brush has a two-sided base plate having a first side moveable into substantially parallel adjacency with the surface to be stippled, an oppositely disposed second side, and an outer edge. The first side of the base plate has disposed therein a predetermined pattern of brush receptacles which are all acutely angled at substantially the same angle with respect to a central axis extending perpendicularly through the base plate, and which radiate outwardly therefrom toward the outer edge of the base plate. A plurality of brush elements having predetermined lengthwise extents are disposed in the brush receptacles at orientations defining substantially the same acute angle with respect to the central axis of the base plate as the brush receptacles. The brush elements extend radially outwardly toward the outer edge of the base plate to expose their lengthwise extents so that substantial portions thereof contact the surface upon movement of the base plate first side into substantially parallel adjacency with the surface. Upon their withdrawal from contact with the surface, the lengthwise extents of the brush elements transfer a generally radial, consistently repeatable predetermined pattern to the stipplable topping compound.

19 Claims, 6 Drawing Sheets

METHOD FOR TRANSFERRING PATTERNS TO A STIPPLABLE TOPPING COMPOUND USING A STIPPLE BRUSH

CROSS REFERENCE TO RELATED APPLICATION

This application is a divisional of application Ser. No. 08/073,776 filed Jun. 5, 1993 which was a continuation-in-part of application Ser. No. 07/773,020 filed Oct. 7, 1991, now abandoned which was a continuation-in-part of application Ser. No. 07/597,885, filed Oct. 15, 1990, now abandoned.

BACKGROUND OF THE INVENTION

The finishing of drywalled ceilings in newly constructed or remodeled homes and offices typically employs a stippling process whereby ceilings are endowed with a textured, in lieu of a smooth, plastered finish. Application of such stippling textures can add aesthetic appeal to a room while simultaneously lessening the time required to "finish" the ceiling since minor surface imperfections are concealed by the applied texture.

During the construction of drywall type ceilings, adjacent drywall sheets abuttably contact one another, forming a discontinuous joint. Where a finished surface is desired, this joint is typically covered by the plasterer applying a plaster-based joint compound and paper tape over the seam and then smoothed out with a trowel to give the appearance of a continuous surface. After the compound has dried completely, a finishing coat of compound is applied. Where a textured ceiling finish is desired, a coat of topping compound is applied to the entire ceiling to be textured with a roller brush after the second coat of compound has been allowed to dry. Immediately upon applying the topping compound and while it is still wet, repetitive stipple patterns may be applied to the compound with a bristled brush to impart a texture to the ceiling surface. The texture pattern created by a brush is, to a large extent, determined by the length, angle and density of the brush's bristle population, as well as the viscosity of the topping compound. Stipple patterns are imparted into the wet topping compound as the contacting portion of the brush elements are drawn away from the compound.

A commonly practiced method of applying stipple patterns employs a conventional window cleaning brush attached to the end of a handle which is then dabbed into wet topping compound. While other types of brushes could be employed to apply stipple texture, such as a hatter's brush disclosed in U.S. Pat. No. 396,812, window cleaning brushes are typically used because they are readily available to the drywall finishing wade. However, since window cleaning brushes are provided with vertically oriented and densely populated bristle arrangements, they must be substantially altered in order for them to be used as stipple brushes capable of applying consistent, generally radial stipple patterns. Such bristle arrangement, if used in its unmodified state, would produce an inconsistent and discontinuous pattern, since it is the outer portions of the bristle lengths that would be contacting the topping compound and imparting a pattern. Even if compressed against the compound covered ceiling, the untrained window brush will not leave a consistent radial patterns, since successive contact with the ceiling may be made with differing pressures and the bristles may spread differently each time. Consequently, any untrained brush, having generally vertically oriented bristle arrangements, would not produce a consistent, generally radial stipple pattern since such pattern requires continuous lengthwise bristle contact with the wet topping compound.

In order to modify standard brushes to produce a generally radial stipple pattern, a substantial portion of the brush's bristles must first be removed. This thinning is required so the vertically disposed bristles can be trained in a radiating manner allowing the lengthwise extent of the bristles to make parting contact with the topping compound. Bristle elements may be trained to be biased in such a radial manner by compressing a wet brush face down against a flat surface for a period of time. Alternately, pre-trained window cleaning brushes are commercially available, such as the stipple texture brushes offered by Goldblair Co. However, while the Goldblatt brush offers time savings which is normally spent in training a brush to lie flat, the Goldblatt brush offers no other advantages over the standard, unmodified and untrained window cleaning brush. Only after a window brush's bristles have been adequately thinned out and trained to lie flat can the brush effectively be used to apply consistent radial stipple patterns. However, even modified and trained window brushes may produce inconsistent stipple patterns since the modification process may vary substantially from one brush to the next. Further, inconsistent patterns may be introduced through improper storage of a brush between uses, effectively "retraining" the brush elements in an undesirable orientation.

Inconsistent stipple patterns are not desirable, are often a source of customer complaint and may require the complete removal of the nonconforming ceiling texture. Removing dried topping compound is time consuming and generally represents an expense borne the drywall contractor. Consequently, it is often necessary to employ a single modified window brush to finish the entire ceiling of a house to avoid visual inconsistencies that would lead to such remedial measures.

In addition to producing stipple patterns which may unintentionally vary from one modified brush to the next, the conversion of a conventional window cleaning brush into a stippling brush is inconvenient, time consuming, and prevents the brush from being used until after it has been so conditioned.

A preferred stipple brush would employ pre-biased brush elements which would not require substantial pre-conditioning and whose brush elements would produce a predetermined variety of distinctive, yet repeatable, stipple patterns. Such a pre-trained stipple brush having predetermined patterns of brush elements would save drywallers time and produce more consistent textural results. Additionally, the brush would be easily configured to provide for proper storage between uses to avoid the need for corrective bristle training.

BROAD STATEMENT OF THE INVENTION

The present invention is directed to a stipple brush having a defined pattern of angled bristle receptacles which overcomes many of the drawbacks inherent in the makeshift stipple brushes known in the art. In having inherently biased bristles, the inventive brush eliminates the inconvenience and delay associated with the training of window or other brushes for use in stippling. Additionally, the inventive brush effects a consistent, radially-patterned texture in the stippled medium with only moderate stress on the brush elements.

It is, therefore, an object of the present invention to provide a stipple brush for transferring patterns to stipplable topping compound on a surface, the brush having a base plate with first and second oppositely disposed sides. The first side is moveable into adjacency with the surface and has a predetermined pattern of brush receptacles therein which are angularly disposed for normally retaining brush elements in an orientation defining an acute angle with respect to perpendicularly through the base plate such that the lengthwise extent of the brush elements initially contact the surface upon its movement into adjacency with the surface. The brush elements are of select length and are fixed within the receptacles at substantially the same acute angle to form a predetermined pattern for transferring a generally radial pattern to, the stipplable topping compound upon contact with the lengthwise extent of the brush elements.

Advantages of the present invention include a brush which imparts a consistent, predetermined pattern or texture to a ceiling or the like without the inconvenience and delay associated with the training of the vertically-bristled window brushes which heretofore have been employed by those in the drywall finishing trade. Other advantages of the present invention will be readily apparent to those of ordinary skill in the art based upon the disclosure contained herein.

DETAILED DESCRIPTION OF THE INVENTION

For illustrative purposes, the present invention is described in the discourse to follow in conjunction with the placement of generally radial stipple patterns onto newly installed ceilings. However, it will be appreciated that the present invention has features making it suitable for stippling other surfaces such as walls or the like, and for use in refinishing applications.

Figure 1:
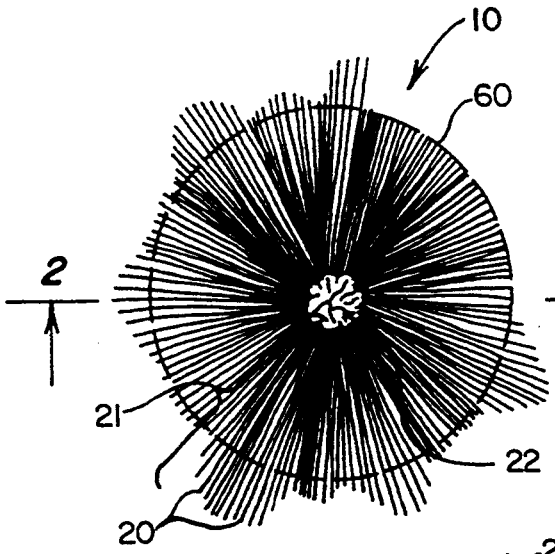
FIG. 1 is a plan view of a stipple, brush according to the present invention with a portion of brush elements shown terminating in a substantially common perimeter.
Figure 2:
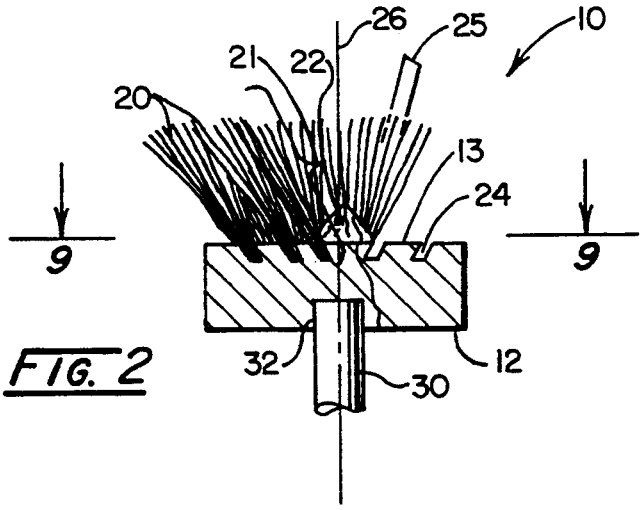
FIG. 2 is a sectional view of the brush of FIG. 1 with a portion of brush elements removed taken through the plane 2—2 of FIG. 1.

Referring initially to FIGS. 1 and 2, a stipple brush according to the present invention is shown generally at 10. Brush 10 has a base plate, 12, one side thereof forming a bristle bearing surface, 13, flora which extends an arrangement of a plurality of brush elements, 20, having predetermined lengthwise extents, 21, for imparting a textured pattern into wet topping compound. Brush elements 20 may be constructed of natural materials, such as horsehair and plant fibers, synthetic materials, or a combination of both. Optionally, a center brush element, 22, may be employed to add a center textural element to the radial stipple pattern. Brush elements 20 are retained in brush receptacles 24 and may be held securely in place by staples, 25. For the purpose of clarity, a portion of FIG. 2 shows brush receptacles 24 with brush elements 20 removed. Although staples 25 are shown for retaining brush elements 20 in brush receptacles 24, numerous other methods for securing brush elements, such as gluing or molding, are known in the art and may be employed.

Brush receptacles 24 are patterned to radiate generally from a central axis, 26, about which plate 12 is symmetrical, for imparting a generally radial pattern to the surface stippled. In addition, substantially all are of brush receptacles 24 are angularly oriented at about the same acute angle with respect to central axis 26. Advantageously, brush elements 20 are retained at substantially the same acute angle with respect to central axis 26 as that at which brush receptacles 24 are disposed. Thus, stipple brush 10 is provided with an inherently biased orientation of brush elements 20 and therefore requires minimal additional training for stippling applications. If incorporated into base plate 12 via a drilling process or the like, it is preferred that brush receptacles 24 are angled from between about 15° to about 30° with respect to central axis 26 to facilitate machining. Alternatively, if receptacles 24 are incorporated into base plate 12 via a forming process such as molding or the like, receptacles 24 may be angled from between about 15° to about 70° with respect to central axis 26. Although it is preferred that substantially all brush receptacles 24 are oriented at the same angle with respect to central axis 26, variances as much as ±5° in the angular orientations of brush receptacles 24 may be tolerated without deleteriously affecting the consistency of the contact between lengthwise extents 21 of brush elements 20 and the stippled surface. Accordingly, such variances are within the precepts of the present invention.

Figure 3:
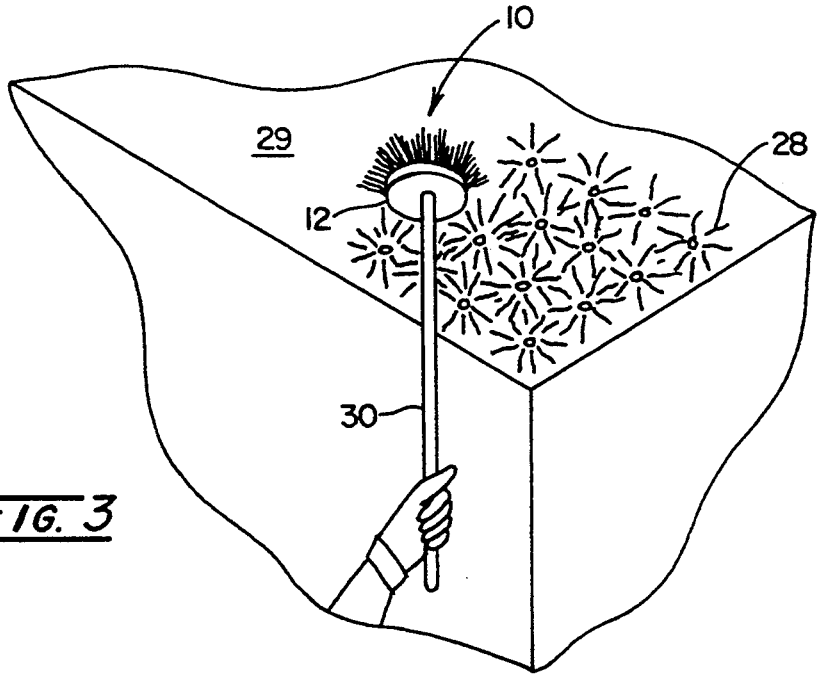
FIG. 3 is a perspective partial view of a ceiling being stippled with the brush of FIG. 1.

Looking next to FIG. 3, stipple brush 10 is illustrated as being used to tactilely stipple generally radially patterns, 28, onto a ceiling surface, represented at 29. In a typical finishing situation, once ceiling surface 29 has been prepared by plastering all of the major seams and cracks, thinned topping compound is applied thereto with a roller brush. The wet topping compound is then patterned or textured by dabbing stipple brush 10 thereinto in a generally repetitive fashion. The viscous property of the topping compound results in a pattern 28 appearing wherever lengthwise extents 21 of brush elements 20 were contacted with and subsequently withdrawn from topping-covered ceiling surface 29. In this manner, multiple advantages are achieved over the finishing a ceiling with a smooth surface, namely, the appearance of ceiling surface 29 bears an aesthetically pleasing patterned texture, and the time and effort needed to finish the ceiling are reduced.

Figure 4:
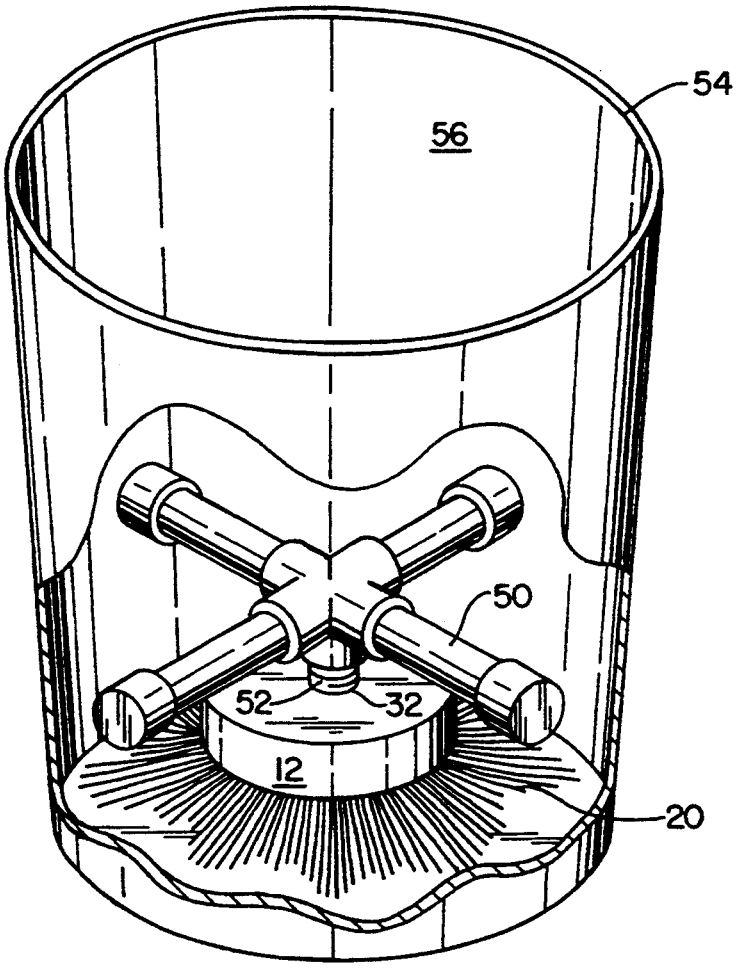
FIG. 4 is a partially sectional view of a storage container housing the stipple brush of FIG. 1 with a mounted crosspiece.

Looking additionally to FIG. 2, it may be appreciated that it is desirable to provide brush 10 with an elongate handle, 30, to facilitate access to ceiling 29 by the drywaller. Brush 10 therefore may be provided with a handle mount, 32, configured to receive an end of handle 30. Preferably, handle 30 is threadably engaged with mount 32 for its removal for storage. In this regard, as is revealed in FIG. 4, once the stippling of ceiling 29 has been completed, handle 30 may be removed from brush 10 and replaced with a multi-spoked crosspiece, 50, which is preferably provided with an upstanding portion, 52, configured to be threadably received by mount 32. Provided with crosspiece 50, stipple brush 10 may be placed face down into a container or the like, 54, for storage. Having dimensions determined by the inside diameter, 56, of storage container 54, crosspiece 50 orients stipple brush 10 in a stable position on the inside bottom of container 54. As such, brush elements 20 remain in their original, predisposed positions and are less likely to be mis-trained by the improper storage of wet stipple brush 10. Since brushes with errant brush elements do not produce consistent stipple patterns 28, insuring proper storage between uses prolongs the useful life of stipple brush 10 and avoids the delay associated with retraining errant brush elements 20.

Returning to FIGS. 1 and 2, and looking also to FIG. 3, it may be appreciated that, inasmuch as stipple patterns 28 are imparted upon contact with lengthwise extents 21 of the brush elements 20, varying the lengths of brush elements 20 and the patterns of brush receptacles 24 correspondingly will affect stipple pattern 28. In one preferred embodiment, all brush elements 20 are terminated in a substantially common perimeter, represented at 60 in FIG. 1 and shown by the removal of a certain outermost portion of brush elements 20.

Figure 5:
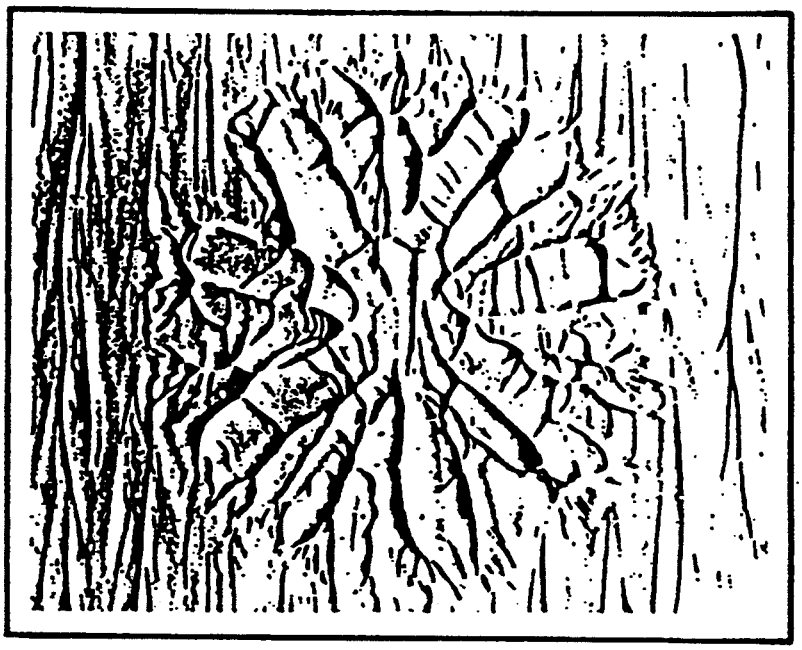
FIG. 5 is a graphically represented drawing of a generally radial pattern imparted to a topping compound by a stipple brush according to the present invention.
Figure 6:
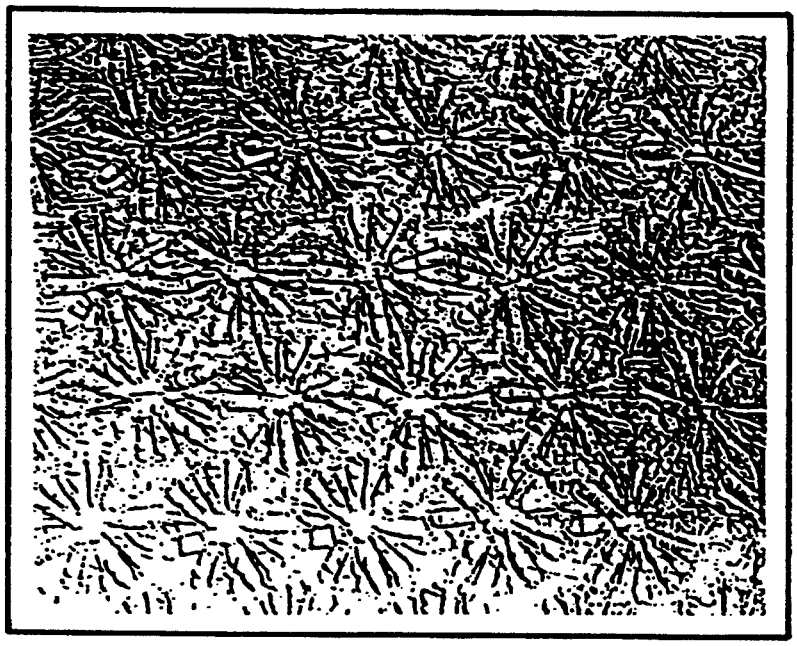
FIG. 6 is a graphically represented drawing of a series of rows of generally radial patterns imparted to a topping compound by a stipple brush according to the present invention.
Figure 7:
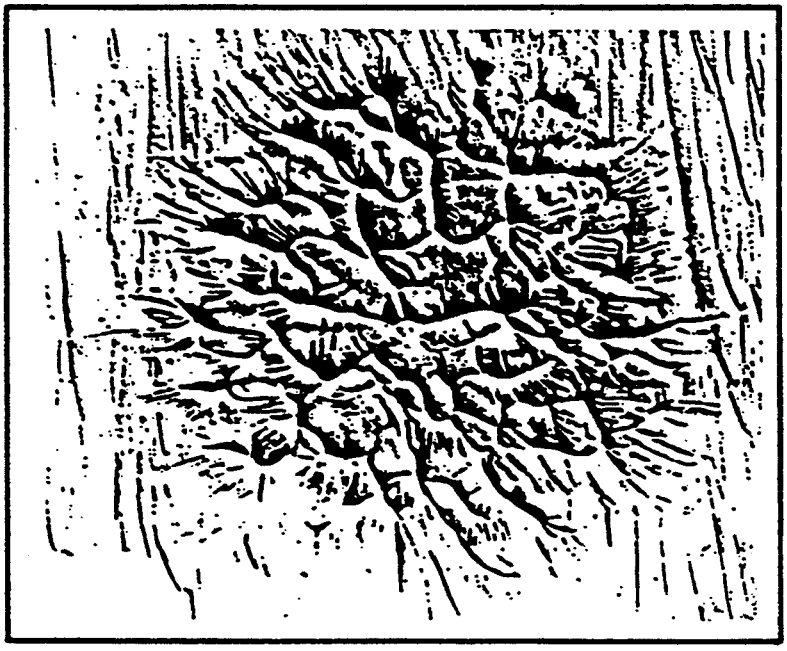
FIG. 7 PRIOR ART
FIG. 7 is a graphically represented drawing of a generally discontinuous pattern imparted to a topping compound by a trained, but unpatterned, brush according to the prior art having vertically oriented bristles.
Figure 8:
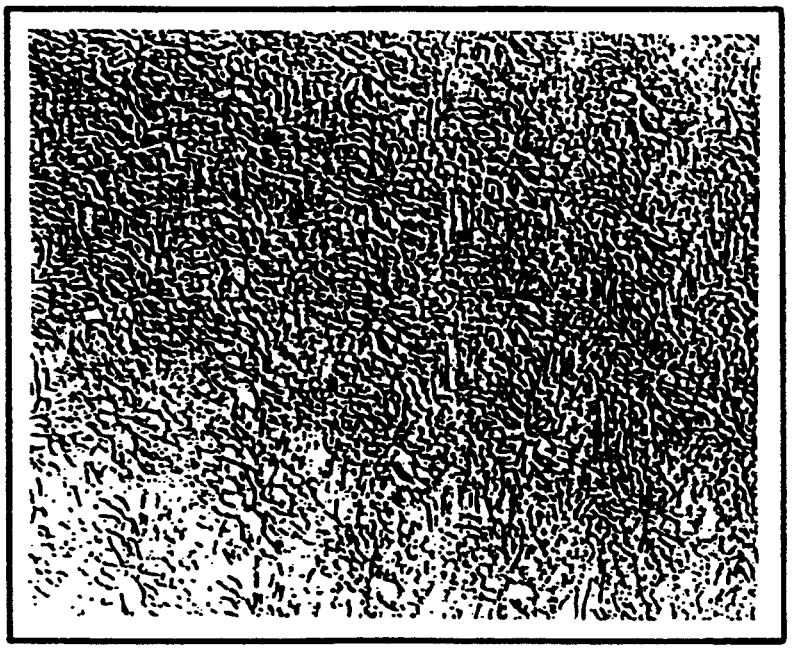
FIG. 8 PRIOR ART
FIG. 8 is a graphically represented drawing of a series of rows of discontinuous patterns imparted to a topping compound by a trained, but unpatterned, brush having vertically oriented bristles according to the prior the art.

Referring now to FIG. 5, the generally radial pattern imparted to a wet topping compound by brush 10 of the present invention is graphically depicted. A series of successive individual patterns is further depicted in FIG. 6 which shows the visual consistency between adjacent patterns. In contrast, FIG. 7 illustrates the relatively discontinuous stipple pattern imparted by the typical window cleaning brushes available in the art, such as the Stipple-Tex model manufactured by Wright Bernet Co. Also in contrast, FIG. 8 shows the relatively poorly-defined ceiling texture created by a trained albeit unpatterned window brush. The ceiling texture created by the trained widow cleaning brush generally is less desirable aesthetically than the radial pattern, depicted in FIGS. 5 and 6, produced by stipple brush 10 of the present invention. Thus, it may be seen that it is the combination of angled and patterned brush receptacles 24 that synergistically effects the desirable, generally radial stipple pattern of FIGS. 5 and 6 and makes the stipple brush 10 of the present invention unique over those heretofore known in the art.

Referring now to FIGS. 9–15 generally, graphically depicted therein are representative predetermined patterns of brush receptacles 24 on brush base plate 12 which, with retained brush elements 20 (FIGS. 1 and 2), effect a variety of generally radial stipple patterns 28 when employed according to the present invention. For a base plate 12 having a diameter of from about 4 inches (8.8 cm) to about 8 inches (17.6 cm), it is generally preferred that from 1 to 9 circular rows of from about 4 to 20 brush receptacles 24 are provided. However, it will be understood that any number of brush receptacles 24 may be disposed on base plate 12 in any number of predetermined patterns or permutations thereof.

Figure 9:
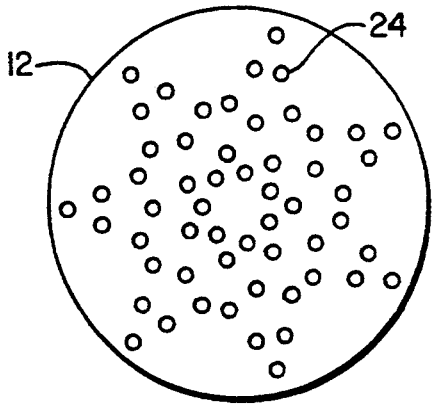
FIGS. 9–18 are alternate brush receptacle patterns according to the invention looking through the plane 9—9 shown in FIG. 2.
Figure 10:
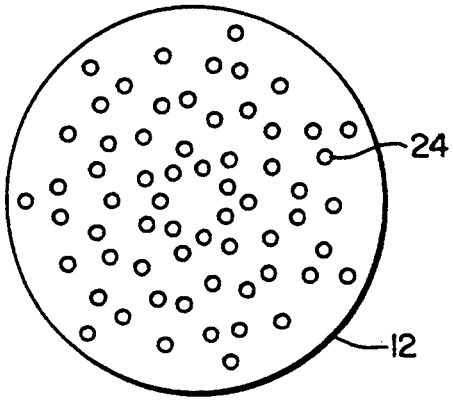
Figure 11:
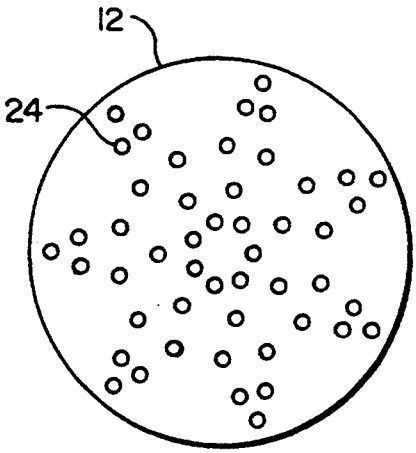
Figure 12:
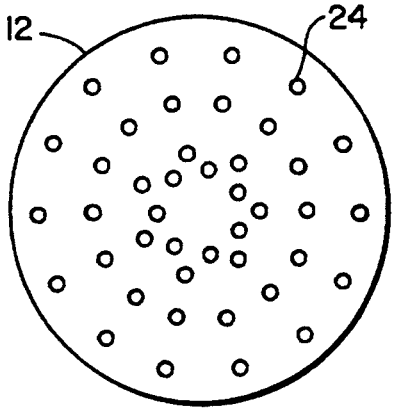
Figure 13:
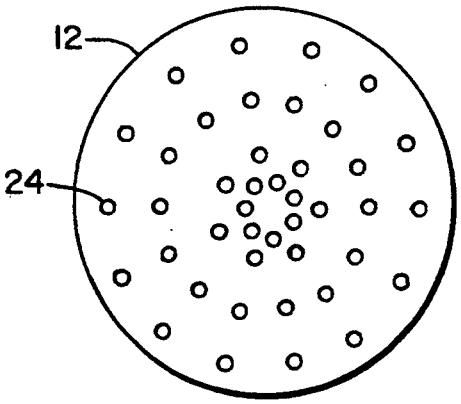
Figure 14:
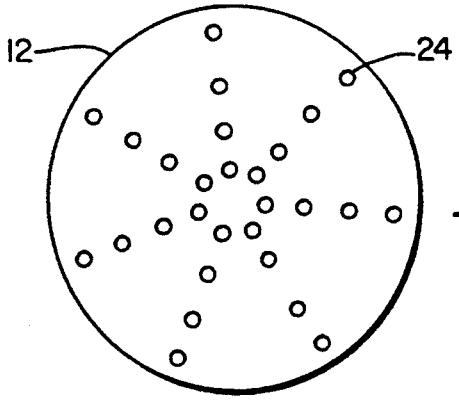
Figure 15:
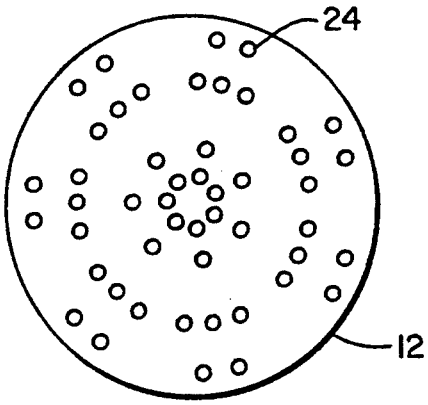
Figure 16:
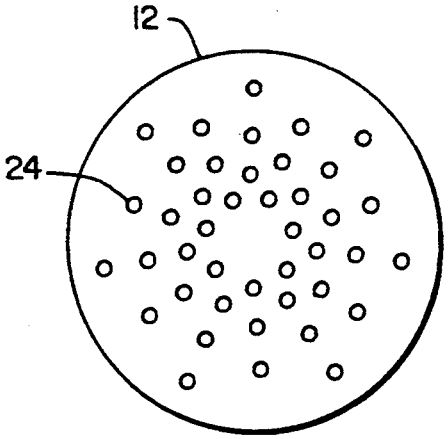
Figure 17:
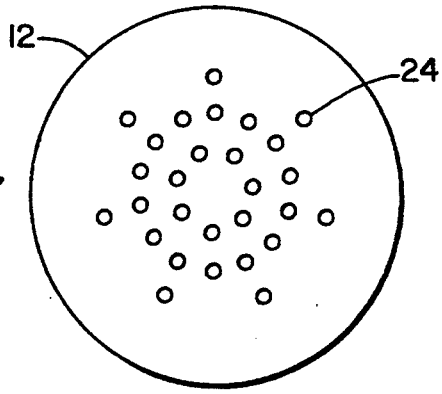
Figure 18:
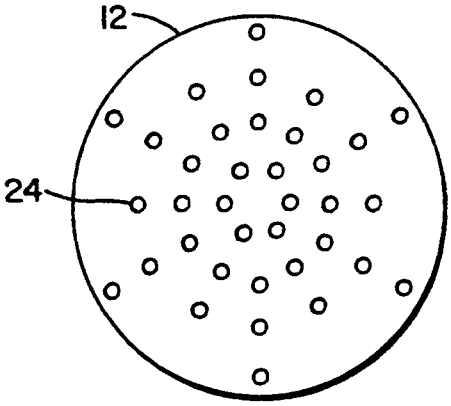

Looking now to FIGS. 9–15 particularly, FIG. 9 shows a predetermined pattern of brush receptacles having a 7 pointed star-shaped perimeter surrounding 3 groups of receptacles evenly spaced around a corresponding number of concentric circles therein. FIG. 10 shows a predetermined pattern of brush receptacles as described in reference to FIG. 9 and having in addition receptacles distributed evenly around a common radius extending beyond the star-shaped perimeter. FIG. 1 I shows a predetermined pattern of brush receptacles having a 7 pointed star-shaped perimeter surrounding 2 groups of receptacles evenly spaced around a corresponding number of concentric circles therein. FIG. 12 shows a predetermined pattern of brush receptacles having a circular perimeter having evenly spaced receptacles surrounding 3 groups of receptacles evenly spaced around a corresponding number of concentric circles therein. FIG. 13 shows a predetermined pattern of brush receptacles as described in reference to FIG. 12 but in which the innermost concentric circle has a radius of about one half that of the next larger concentric circle. FIG. 14 shows a predetermined pattern of brush receptacles having a circular perimeter with evenly spaced receptacles surrounding 3 groups of receptacles evenly spaced around a corresponding number of concentric circles therein and in radial alignment with receptacles in adjacent concentric groups. FIG. 15 shows a predetermined pattern of brush receptacles having a circular perimeter with a plurality of evenly spaced, paired receptacles, the perimeter surrounding 3 groups of receptacles spaced around a corresponding number of concentric circles therein. FIG. 16 shows a predetermined pattern of brush receptacles having a circular perimeter row of evenly spaced receptacles surrounding concentric inner rows of evenly spaced receptacles, the receptacles in adjacent rows being in a staggered radial alignment. FIG. 17 shows a predetermined pattern of brush receptacles having a circular perimeter row of evenly spaced receptacles surrounding concentric inner rows of evenly spaced receptacles, the perimeter row being in radial alignment with and having one half the number of receptacles as the inner row adjacent thereto, and the inner rows being in a staggered radial alignment wherein each inner row has one half the number of receptacles as the next larger inner row. Lastly, FIG. 18 shows a predetermined pattern of brush receptacles having a circular perimeter row of evenly spaced receptacles surrounding concentric inner rows of evenly spaced receptacles, the perimeter row being in radial alignment with and having one half the number of receptacles as the inner row adjacent thereto, and adjacent inner rows being in a staggered radial alignment wherein each has one half the number of receptacles as the next larger inner row.

Since certain changes may be made without departing from the scope of the invention herein involved, it is intended that all matter contained in the foregoing description or shown in the accompanying drawings shall be interpreted as illustrative and not in a limiting sense.

What is claimed:

1. A method for transferring patterns to a stipplable topping compound on a surface, comprising the steps of:

(a) providing a stipple brush comprising:

a base plate having an outer edge, a first side, a second oppositely disposed side, and a central axis extending perpendicularly through said base plate, said first side having a predetermined pattern of brush receptacles disposed therein such that all said brush receptacles are acutely angled at about the same angle with respect to the central axis and radiate from said central axis outwardly toward said outer edge of said base plate; and a plurality of brush elements having predetermined lengthwise extents disposed in said brush receptacles in orientations defining substantially the same acute angle with respect to said central axis, said brush elements extending radially outwardly toward said outer edge of said base plate to expose their lengthwise extents;

(b) moving said stipple brush first side into substantially parallel adjacency with said surface;

(c) contacting said surface with the lengthwise extents of said brush elements; and (d) withdrawing the lengthwise extents of said brush elements from contact with said surface to transfer a generally radial, consistently repeatable predetermined pattern to the topping compound.

2. The method of claim 1 further comprising the step of:

(e) repeating steps (b), (c), and (d) to cover said surface with a series of rows of the predetermined generally radial pattern.

3. The method of claim 1 wherein some of said brush elements are of a different length for transferring said predetermined generally radial pattern to said topping compound conforming to said brush elements.

4. The method of claim 1 wherein the lengths of said brush elements are terminated in a substantially common circular perimeter for transferring a generally radial pattern having a substantially circular outer boundary to said stipplable topping compound.

5. The method of claim 1 wherein said stipple brush includes a central brush element for transferring a generally radial stipple pattern having a central textural feature formed by said central brush element to said stipplable topping compound.

6. The method of claim 1 wherein said second side has a mount.

7. The method of claim 6 further comprising a handle mounted to said mount, said handle being disposed substantially perpendicular to said second side of said base plate and configured for moving said first side of said base plate into substantially parallel adjacency with said surface.

8. The method of claim 1 in which said predetermined pattern of brush receptacles is comprised of a 7 pointed star-shaped perimeter surrounding 3 groups of receptacles, said grouped receptacles being evenly spaced around a corresponding number of concentric circles therein.

9. The method of claim 8 in which said predetermined pattern of brush receptacles further comprises receptacles distributed evenly around a common radius extending beyond said star-shaped perimeter.

10. The method of claim 1 in which said predetermined pattern of brush receptacles is comprised of a 7 pointed star-shaped perimeter surrounding 2 groups of receptacles, said grouped receptacles being evenly spaced around a corresponding number of concentric circles therein.

11. The method of claim 1 in which said predetermined pattern of brush receptacles is comprised of a circular perimeter having evenly spaced receptacles surrounding 3 groups of receptacles, said grouped receptacles being evenly spaced around a corresponding number of concentric circles therein.

12. The method of claim 11 in which the innermost concentric circle has a radius of about one half that of the next larger concentric circle.

13. The method of claim 1 in which said predetermined pattern of brush receptacles is comprised of a circular perimeter having evenly spaced receptacles surrounding 3 groups of receptacles, said grouped receptacles being evenly spaced around a corresponding number of concentric circles therein and in radial alignment with receptacles in adjacent concentric groups.

14. The method of claim 1 in which said predetermined pattern of brush receptacles is comprised of a circular perimeter having a plurality of evenly spaced paired receptacles, said perimeter surrounding 3 groups of receptacles, said grouped receptacles being spaced around a corresponding number of concentric circles therein.

15. The method of claim 1 in which said predetermined pattern of brush receptacles is comprised of a circular perimeter row of evenly spaced receptacles surrounding concentric inner rows of evenly spaced receptacles, the receptacles in adjacent said rows being in a staggered radial alignment.

16. The method of claim 1 in which said predetermined pattern of brush receptacles is comprised of a circular perimeter row of evenly spaced receptacles surrounding concentric inner rows of evenly spaced receptacles, said perimeter row being in radial alignment with and having one half the number of receptacles as the inner row adjacent thereto, and said inner rows being in a staggered radial alignment wherein each of said inner rows has one half the number of receptacles as the next larger inner row.

17. The method of claim 1 in which said predetermined pattern of brush receptacles is comprised of a circular perimeter row of evenly spaced receptacles surrounding concentric inner rows of evenly spaced receptacles, said perimeter row being in radial alignment with and having one half the number of receptacles as the inner row adjacent thereto, and adjacent said inner rows being in a staggered radial alignment wherein each has one half the number of receptacles as the next larger inner row.

18. The method of claim 1 in which all said brush receptacles are acutely angled at about the same angle of from between about 15° to about 70° with respect to said central axis of said base plate.

19. The method of claim 18 in which all said brush receptacles are acutely angled at about the same angle of from between about 15° to about 30° with respect to said central axis of said base plate.

* * * * *